US007544274B2

(12) United States Patent
Miyazawa et al.

(10) Patent No.: US 7,544,274 B2
(45) Date of Patent: Jun. 9, 2009

(54) PLATING DEVICE AND PLATING METHOD

(75) Inventors: Hiroshi Miyazawa, Tokyo (JP); Terumasa Inao, Tokyo (JP)

(73) Assignee: Dowa Metaltech Co., Ltd., Tokyo (JP)

( * ) Notice: Subject to any disclaimer, the term of this patent is extended or adjusted under 35 U.S.C. 154(b) by 737 days.

(21) Appl. No.: 11/316,922

(22) Filed: Dec. 27, 2005

(65) Prior Publication Data

US 2006/0137987 A1 Jun. 29, 2006

(30) Foreign Application Priority Data

Dec. 27, 2004 (JP) ..... 2004-376955

(51) Int. Cl.
*C25D 13/00* (2006.01)

(52) U.S. Cl. ..... 204/206; 204/224 R; 204/212; 205/130; 205/138

(58) Field of Classification Search ..... 204/199, 204/202, 206, 212, 224 R; 205/130, 133, 205/134, 138
See application file for complete search history.

(56) References Cited

U.S. PATENT DOCUMENTS 3,900,383 A * 8/1975 Austin et al. ..... 204/211

FOREIGN PATENT DOCUMENTS

JP B 46-6322 2/1971
JP A 51-16238 2/1976

* cited by examiner

*Primary Examiner*—Nam X Nguyen
*Assistant Examiner*—Luan V Van
(74) *Attorney, Agent, or Firm*—Oliff & Berridge, PLC

(57) ABSTRACT

There is provided a plating method and device having a fixed drum (20) in which an anode (21) is exposed on the external peripheral surface; a rotating drum provided on the external periphery of the fixed drum, onto which a workpiece W transported in the longitudinal direction is wound; an annular opening (35) formed at the bottom of the rotating drum and provided so as to penetrate from the external periphery of the rotating drum to the internal periphery continuously in the peripheral direction of the rotating drum; a plating solution feeding channel (22) that leads into the fixed drum and is formed in a position on the external periphery of the fixed drum corresponding to the angle position (52*a*) of the prescribed arc of contact of the rotating drum onto which the workpiece is wound; a plating device for feeding the plating solution to the flow channel using the tunnel-shaped space (52) enclosed by the workpiece wound on the external periphery of the rotating drum, the peripheral wall of the annular opening, and the external periphery of the fixed drum as the flow channel.

11 Claims, 4 Drawing Sheets

(a)

(b)

PLATING DEVICE AND PLATING METHOD

BACKGROUND OF THE INVENTION

1. Field of the Invention

The present invention relates to a plating device for continuously performing a metal plating on the surface of a strip-shaped or linear workpiece (plated material), and to a plating method.

2. Description of the Related Art

The plating device disclosed in JP-B 46-6322 or in JP-A 51-16238 is proposed as an example of a conventional plating device for continuously forming a metal plating on the surface of a strip-shaped or linear workpiece. The plating device and plating method according to these conventional techniques will be briefly described below with reference to the drawings.

FIG. 3 shows an example of the plating device disclosed in JP-B 46-6322.

This plating device has two drums 101A and 101B capable of rotating about the axis in the transverse direction and moving in the axis direction, arranged coaxially at a prescribed interval; work guides 102 and 103 for continuously feeding a workpiece 100 from the top of the drums 101A and 101B and guiding the workpiece over the drums so that the edges thereof are superposed on the external peripheral surfaces of both drums; and a feeding vent 104 and a discharge vent 105 for feeding the plating solution to a half-cylindrical space formed by the drums 101A and 101B and the workpiece 100. The device is configured so as to discharge the plating solution while the workpiece 100 is continuously fed, and to continuously apply a plating having a desired width on the workpiece 100 in the longitudinal direction. In this arrangement, the drums 101A and 101B are anodes, and rubber or another elastic insulating material 106 is wound onto the portion of the external periphery of the drums 101A and 101B that contacts the workpiece 100.

FIG. 4 shows an example of the conventional plating device disclosed in JP-A 51-16238.

In this plating device, an elastic insulator 122 is fixed to the external periphery of a rotatable drum 121 having anode characteristics, the external periphery of the drum 121 is exposed by providing a groove 123 in the elastic insulator 122 along the peripheral direction thereof, and a plating treatment is performed by applying a voltage between the drum 121 and a workpiece 100 while transporting the workpiece 100 wound on the external periphery of the drum 121 over the elastic insulator 122, feeding the plating solution to the groove 123 from the starting point 123*a* as indicated by the arrow A, and discharging the plating solution from the end point 123*b* as indicated by the arrow B.

SUMMARY OF THE INVENTION

In the conventional plating devices and plating methods described above, since the workpiece 100 is wound directly onto the external periphery of the drums 101A, 101B, and 121 used as the anode, and the drums 101A, 101B, and 121 themselves rotate in conjunction with the workpiece 100, management of the anode for each plating type is difficult, and the cost thereof can easily increase.

From the perspective of plating solution circulation, since the plating solution is fed into the half-cylindrical space formed inside the drums 101A and 101B in the example shown in FIG. 3, the flow rate on the plated surface decreases, the stirring in the vicinity of the plated surface becomes inadequate, and other problems occur, and high-speed plating becomes difficult to accomplish. In the example shown in FIG. 4, since the plating solution is caused to flow in the groove 123 from the starting point 123*a* towards the end point

123*b*, the plating in the vicinity of the end point 123*b* can easily become burned, making high-speed plating difficult.

In view of the foregoing problems, an object of the present invention is to provide a plating device and plating method whereby cost can be reduced by making it easier to manage the anode, and the plating rate can be increased by improving the circulation of the plating solution.

In order to solve the abovementioned problems, a first aspect of the present invention provides a plating device comprising a fixed drum in which a counter electrode is exposed on the external peripheral surface; a rotor rotatably disposed via a prescribed gap on the external periphery of the fixed drum, and onto the external periphery of which a belt-shaped or linear workpiece transported in the longitudinal direction is wound with a prescribed arc of contact range; an annular opening formed at the bottom of the position in the width direction of the peripheral surface of the rotor onto which the workpiece is wound, and provided so as to continue in the peripheral direction of the rotor and penetrate from the external periphery to the internal periphery of the rotor; a plating solution feeding channel formed in a position on the external periphery of the fixed drum corresponding to the angle position of the prescribed arc of contact of the rotor onto which the workpiece is wound; and a plating solution feeding system, enclosed by the workpiece wound onto the external periphery of the rotor, the peripheral wall of the annular opening formed in the rotor, and the external periphery of the fixed drum, for feeding the plating solution from the solution feeding channel to a duct using a tunnel-shaped space along the external periphery of the fixed drum as the duct, and discharging the plating solution from both ends of the tunnel-shaped space in which the workpiece and the rotor move away from each other.

A second aspect of the present invention provides the plating device according to the first aspect wherein the rotor is provided in a movable or replaceable manner so that the width of the annular opening can be changed.

A third aspect provides the plating device according to the first or second aspect wherein an annular groove in which the workpiece is closely wound onto the bottom surface of the groove is formed in the external periphery of the rotor, and the annular opening having a size that is smaller than the width of the bottom surface of the groove is formed in the bottom surface of the annular groove.

A fourth aspect provides the plating device according to the third aspect wherein a mask for defining the plating area is positioned on the bottom surface of the annular groove, and the workpiece can be wound onto the mask.

A fifth aspect provides the plating device according to any of the first through fourth aspects wherein a fixed shaft pointing in the vertical direction is provided through the center of the fixed drum and rotor, the fixed drum is nonrotatably supported by the fixed shaft, and the rotor is rotatably supported in a substantially horizontal plane.

A sixth aspect provides the plating device according to the fifth aspect wherein the rotor is detachably attached between the external peripheral ends of a top end-face panel and a bottom end-face panel rotatably supported by the fixed shaft; the fixed drum is accommodated by a space formed by the top and bottom end-face panels and the rotor; and a discharge vent for discharging the spent plating solution downward that is discharged from both ends of the tunnel-shaped space is provided to the bottom end-face panel.

A seventh aspect provides the plating device according to the sixth aspect wherein the fixed drum is formed so that only the angle range thereof corresponding to the prescribed arc of contact range has a large diameter, and the remaining angle range has a small diameter, whereby an arcuate space is maintained on the external peripheral side of the portion formed by the small diameter, and the arcuate space is used as a discharge channel for discharging from the discharge vent the spent plating solution discharged from both ends of the tunnel-shaped space.

An eighth aspect provides a plating method for performing prescribed plating on a belt-shaped or linear treatment object moving in the longitudinal direction while causing the treatment object to come in contact with a plating device, comprising:

providing a continuous groove narrower than the width of the treatment object to the portion of the plating device with which the treatment object comes in contact, and feeding a prescribed plating solution from the side of the plating device to a tunnel-shaped space formed by the plating device, the treatment object, and the groove; and passing an electric current between the plating device and the treatment object and performing prescribed plating on the portion at which the treatment object comes in contact with the plating solution, while a portion of the plating solution flows in the direction in which the treatment object travels through the tunnel-shaped space, and the other portion of the plating solution flows in the opposite direction from the direction in which the treatment object travels through the tunnel-shaped space.

A ninth aspect provides a plating method comprising:

winding a belt-shaped or linear workpiece transported in the longitudinal direction with a prescribed arc of contact range onto the external periphery of a rotor that has the peripheral wall of an annular opening and is rotatably disposed via a prescribed gap on the external periphery of a fixed drum in which a counter electrode is exposed on the external peripheral surface; and feeding a plating solution from a plating solution feeding channel formed in the position on the external periphery of the fixed drum that corresponds to the angle position of the prescribed arc of contact range to a tunnel-shaped space along the external periphery of the fixed drum enclosed by the workpiece wound onto the external periphery of the rotor, the peripheral wall of the annular opening formed in the rotor, and the external periphery of the fixed drum, passing an electric current between the counter electrode and the workpiece while discharging the plating solution from both ends of the tunnel-shaped space in which the workpiece and the rotor move away from each other, and performing prescribed plating on the workpiece.

A tenth aspect provides the plating method according to the eighth or ninth aspect wherein the prescribed plating is gold plating.

According to the first aspect, the drum having a counter electrode exposed on the external peripheral surface thereof is fixed, a rotor that is separate from the drum is disposed on the external periphery thereof, the workpiece is wound onto the external periphery of the rotor, and the workpiece is made to face the counter electrode via the plating solution through the annular opening formed in the rotor. Therefore, the counter electrode becomes easy to manage. In other words, in such cases as when the plating type is changed, there is no need for any changes on the drum side, a change need only be performed on the rotor side, and complex management of the drum as the counter electrode is no longer needed. Cost can therefore be reduced. The plating solution is fed to the tunnel-shaped space enclosed by the workpiece, the peripheral wall of the annular opening, and the external periphery of the drum. Therefore, the plating solution can be caused to flow parallel to the plated surface at a high flow rate whereby adequate stirring effects can be demonstrated. Since the plating solution is also fed in the middle of the length direction of the tunnel-shaped space, and the plating solution is discharged from both ends of the tunnel-shaped space, the distance from the feeding point to the discharge point can be shortened, and the plating can be prevented from burning. As a result, high-speed plating becomes possible.

According to the second aspect, when, for example, the plating width is changed, these changes can be easily handled since it is sufficient merely to move or replace the rotor and change the width of the annular opening, rather than to move or replace the counter electrode (drum).

According to the third aspect, since an annular groove is formed in the external periphery of the rotor, and the workpiece is secured on the bottom surface of the annular groove, it is possible to shorten the distance between the workpiece and the counter electrode through the annular opening, and the plating efficiency can be increased. Since the workpiece is wound into the annular groove, the winding position of the workpiece in the width direction of the peripheral surface of the rotor can be determined.

According to the fourth aspect, since a mask is disposed in the bottom surface of the annular groove, and the workpiece is wound onto the mask, the plating specification can be changed simply by replacing the mask.

According to the fifth aspect, a simple, stable structure can be obtained since a fixed shaft pointing in the vertical direction is provided through the center of the fixed drum and rotor, and the fixed drum and the rotor are supported by the fixed shaft.

According to the sixth aspect, since the rotor is detachably attached between the external peripheral ends of the top end-face panel and the bottom end-face panel, the rotor can easily be replaced, and the rotor can be supported with a high degree of rigidity. Since the fixed drum is accommodated by a space formed by the top and bottom end-face panels and the rotor, a compact structure can be obtained, and the counter electrode can be protected. Since the spent plating solution is caused to fall downward from the discharge vent of the bottom end-face panel, unnecessary scattering of the spent plating solution can also be prevented.

According to the seventh aspect, the discharge properties of the spent plating solution can be improved since a small-diameter portion is provided to the fixed drum, and the arcuate space formed on the external peripheral side of the small-diameter portion is used as the discharge channel for the spent plating solution.

According to the eighth aspect, a prescribed plating solution is fed from the plating device side to the tunnel-shaped space formed by the plating device, the treatment object, and the groove. Therefore, a portion of the plating solution is caused to flow in the direction in which the treatment object travels through the tunnel-shaped space, and the other portion of the plating solution is caused to flow in the opposite direction from the direction in which the treatment object travels through the tunnel-shaped space. Also, the discharge properties of the spent plating solution can be improved, high-speed plating becomes possible, and productivity can be enhanced.

According to the ninth aspect, since the electric current can be applied at a current density of 60 $A/dm^2$ or higher to the workpiece without causing the plating to burn, high-speed plating becomes possible, and productivity can be enhanced.

According to the tenth aspect, the enhancement of productivity due to high-speed plating described as the effect of the eighth or ninth aspect is particularly significant when the plating performed is gold plating.

BRIEF DESCRIPTION OF THE DRAWINGS

FIG. 3 shows an example of the conventional plating device, wherein FIG. 4 shows another example of a conventional plating device, wherein

DESCRIPTION OF THE PREFERRED EMBODIMENTS

Embodiments of the present invention will be described hereinafter based on the drawings.

Figure 1:
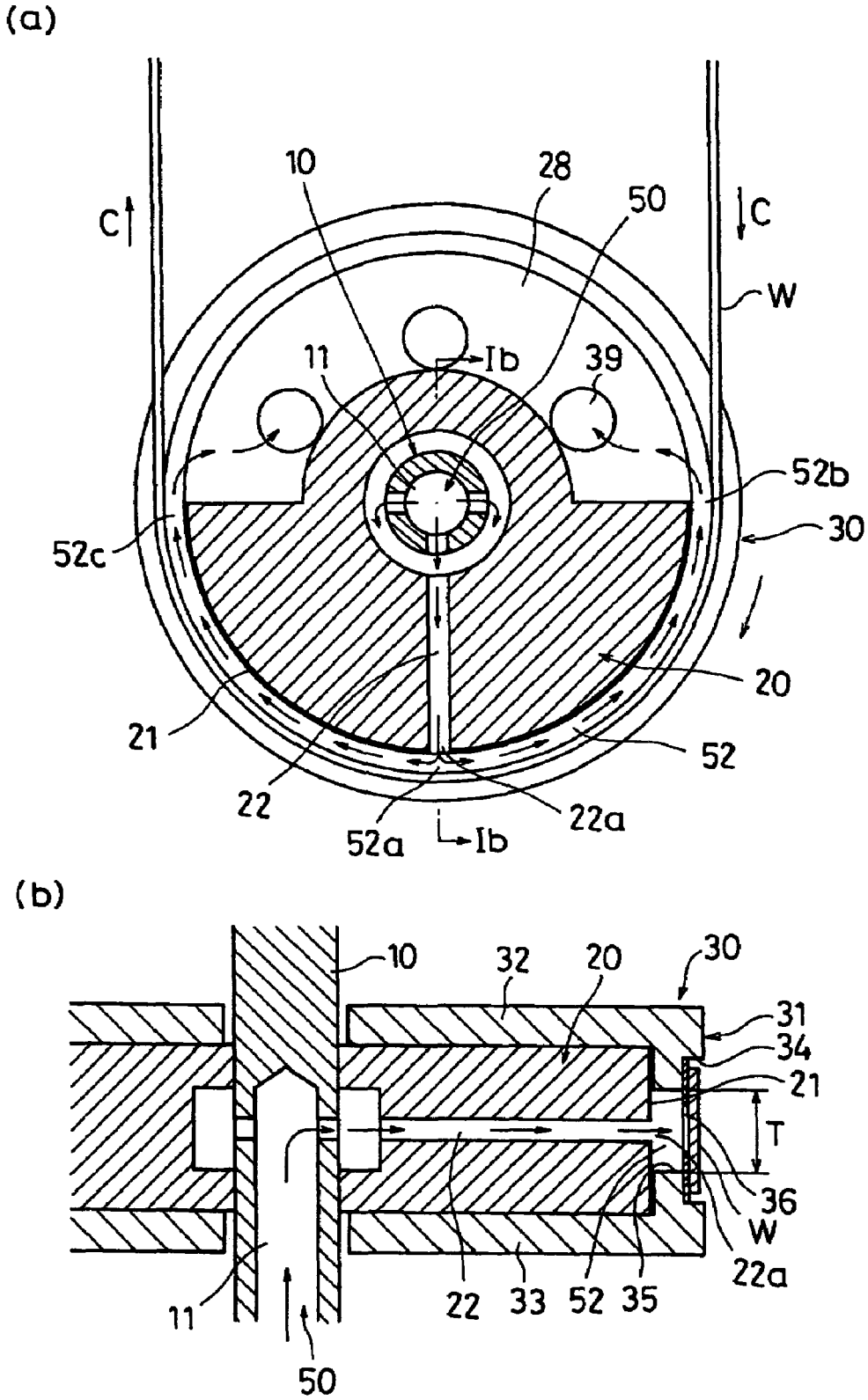
FIG. 1 is a simplified diagram showing the basic structure of the plating device according to an embodiment of the present invention.

FIG. 1 is a simplified diagram showing the basic structure of the plating device of the present embodiment, wherein FIG. 1A is a sectional view from above, and FIG. 1B is a sectional view along the arrow Ib-Ib in FIG. 1A. The schematic structure of the plating device of this embodiment will first be described using this drawing.

In FIG. 1, W indicates the workpiece as the plated member. This workpiece W is strip-shaped, and the workpiece is transported in the length direction thereof (the direction of the arrow C). This plating device has a fixed shaft 10 arranged in the vertical direction from the bottom wall of the plating bath, a fixed drum 20 nonrotatably fixed to the external periphery of the fixed shaft 10, and a rotating drum 30 rotatably supported by the external periphery of the fixed shaft 10 in a substantially horizontal plane. A counter electrode (referred to hereinafter as the anode 21, since this electrode serves as an anode when the plating is a metal plating) composed of platinum or the like is attached in exposed fashion to the external peripheral surface of the fixed drum 20.

The rotating drum 30 is a hollow rotating body having an external peripheral cylinder (rotor) 31, a top end-face panel 32, and a bottom end-face panel 33. The fixed drum 20 is accommodated by the space, and the internal periphery of the external peripheral cylinder 31 faces the external periphery of the fixed drum 20 across a minute gap. The workpiece W transported in the longitudinal direction in a substantially horizontal plane is wound onto the external periphery of this external peripheral cylinder 31 with a prescribed arc of contact range (for example, approximately 180°, which substantially corresponds to a half-circle). The rotating drum 30 therefore rotates in conjunction with the transport direction of the workpiece W.

The external peripheral cylinder 31 attached between the external peripheral ends of the top end-face panel 32 and the bottom end-face panel 33 is composed of a top-side cylinder 31A attached to the top end-face panel 32 and a bottom-side cylinder 31B attached to the bottom end-face panel 33, each fabricated as separate pieces. By maintaining a prescribed gap T between the edges at the ends of the top-side cylinder 31A and the bottom-side cylinder 31B opposite each other, an annular opening 35 continuing in the peripheral direction of the external peripheral cylinder 31 and leading from the external periphery of the external peripheral cylinder 31 to the internal periphery thereof is provided between the end edges.

An annular groove 34 into which the workpiece W is secured in the bottom surface of the groove is formed in the external periphery of the external peripheral cylinder 31, and the aforementioned annular opening 35 is formed with a width smaller than that of the bottom surface of the groove in the bottom surface of the annular groove 34. The annular opening 35 is therefore positioned under the position in the width direction in which the workpiece W is wound on the peripheral surface of the external peripheral cylinder 31. A mask 36 for defining the plating area is placed on the bottom surface of the annular groove 34, and the workpiece W can be wound over this mask 36.

A plating solution feeding channel 22 is formed inside the fixed drum 20. This plating solution feeding channel 22 conducts the plating solution transported via the internal channel 11 of the fixed shaft 10 towards the workpiece W, and the open end 22*a* thereof is placed in a position on the external periphery of the fixed drum 20 that corresponds to the angle position of the substantial center of the arc of contact range of the rotating drum 30 onto which the workpiece W is wound.

The position of the aforementioned plating solution feeding channel 22 formed inside the fixed drum 20 is not necessarily limited to the angle position of the substantial center of the arc of contact range of the rotating drum 30, and the optimum angle position may also be obtained according to the viscosity and other fluid characteristics of the plating solution and the transport speed of the workpiece W. In this case, its position may be determined so that equal quantities of the spent plating solution are discharged from both ends 52*b* and 52*c* of the tunnel-shaped space 52 described hereinafter. This configuration can easily be achieved by adjusting the positions at which the workpiece W makes contact with and separates from the fixed drum 20, for example.

A plurality of plating solution feeding channels 22 may also be provided according to the aforementioned fluid characteristics of the plating solution.

The plating solution is fed using the tunnel-shaped space 52 as a flow channel for plating. The space is enclosed by the workpiece W wound on the external peripheral cylinder 31, the peripheral wall of the annular opening 35, and the external periphery of the fixed drum 20. The space has a rectangular cross-section and extends along the external periphery of the fixed drum 20. Specifically, the plating solution flowing through the internal channel 11 of the fixed shaft 10 is fed from the open end 22*a* of the plating solution feeding channel 22 of the fixed drum 20 to the center 52*a* of the length direction of the tunnel-shaped space 52, and is discharged to the outside from both ends 52*b* and 52*c* of the tunnel-shaped space 52 where the workpiece W and the external peripheral cylinder 31 move away from each other. The plating solution feeding system 50 is composed of a plating solution feeding pump not shown in the drawing, the internal channel 11 of the fixed shaft 10, the plating solution feeding channel 22 in the fixed drum 20, the tunnel-shaped space 52, and other components.

A plurality of discharge vents 39 for discharging the spent plating solution downward from both ends 52*b* and 52*c* of the tunnel-shaped space 52 are formed in the bottom end-face panel 33. This fixed drum 20 is formed so that only the angle range thereof corresponding to the prescribed arc of contact range has a large diameter, and the remaining angle range has a small diameter, whereby an arcuate space 28 is maintained on the external peripheral side of the portion formed by the small diameter, and this arcuate space 28 is used as a discharge channel whereby the spent plating solution discharged from both ends 52*b* and 52*c* of the tunnel-shaped space 52 flows out from the discharge vents 39.

A configuration may also be adopted as a different embodiment of the present invention in which the workpiece W is brought into contact with a plurality of external peripheral cylinders instead of being wound on the external periphery of a single external peripheral cylinder 31. Furthermore, the tunnel-shaped space may be formed by a groove provided to a flat portion of the plating device and the workpiece W transported in contact with the groove, instead of the cylindrical external peripheral cylinder. In any case, the plating solution may be fed to the tunnel-shaped space, and the spent plating solution may be discharged from both ends of the tunnel-shaped space.

The structure of the aforementioned plating device will next be described in further detail using FIG. 2.

Figure 2:
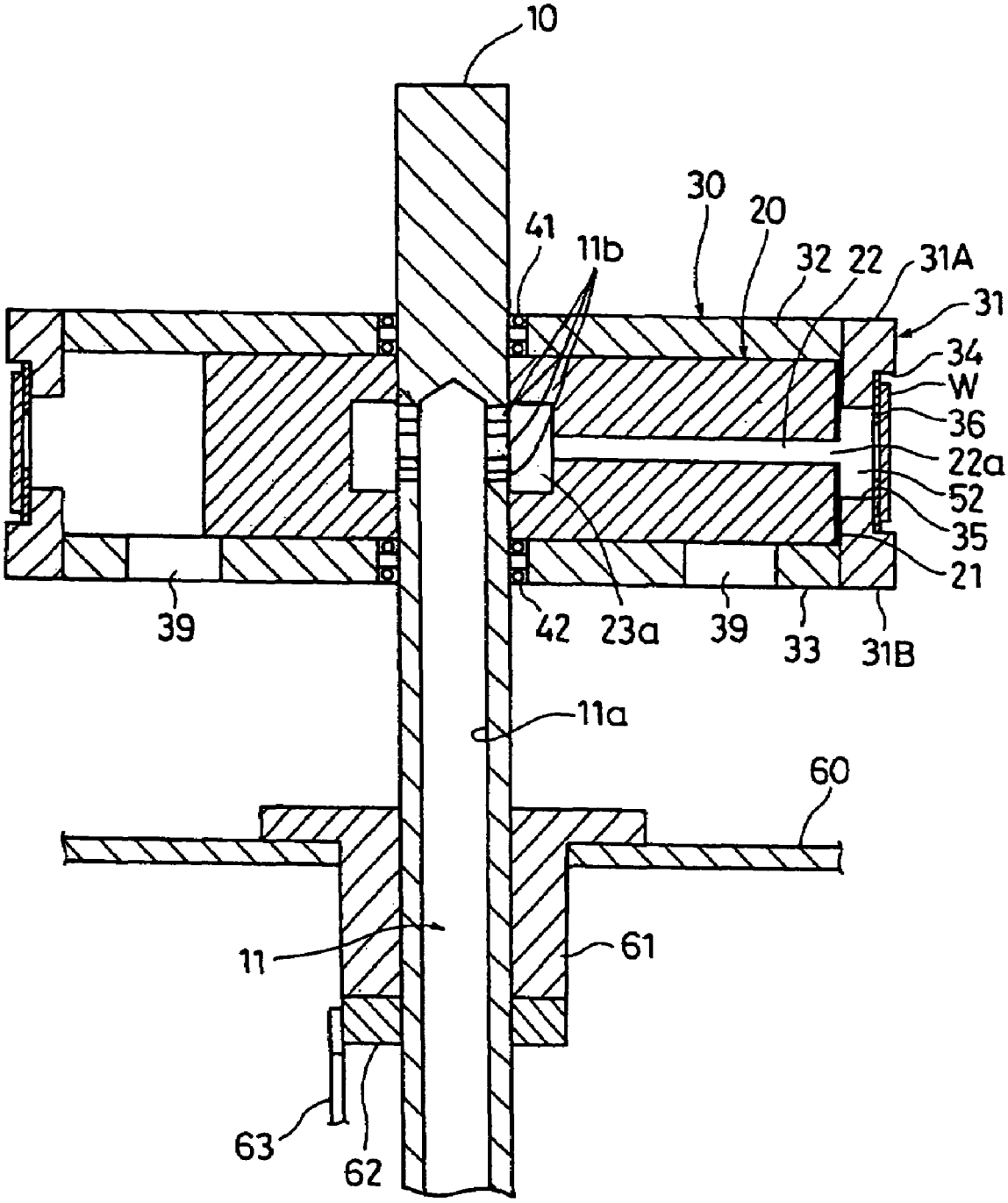
FIG. 2 is a longitudinal sectional view of the structure of the plating device according to an embodiment of the present invention.

FIG. 2 is a longitudinal sectional view of the plating device. Symbols in the drawing that are the same as in FIG. 1 indicate the same members, although the shapes thereof may be somewhat different.

In FIG. 2, the reference numeral 10 indicates a fixed shaft made from a conductive material, 20 indicates a fixed drum made from an insulating material, 30 indicates a rotating drum made from an insulating material, and 60 indicates the bottom wall of the plating bath. The fixed shaft 10 is provided so as to stand on the bottom wall 60 of the plating bath via an insulating flange 61. A conducting wire 63 is electrically connected to the fixed shaft 10 via a conducting ring 62 secured by a screw to the bottom side of the insulating flange 61.

A longitudinal hole 11*a* is made in the fixed shaft 10 from the bottom end face of the shaft as the internal channel 11, and a plurality of transverse holes 11*b* leading to the external peripheral surface are provided to the top of the longitudinal hole 11*a*. The fixed drum 20 is fitted on the external periphery of the fixed shaft 10 in a position in which the fixed drum covers the transverse holes 11*b*.

The main body of the fixed drum 20 has a large diameter in the semicircular portion on the side that corresponds to the arc of contact range of the workpiece W, the other semicircular portion thereof has a smaller diameter, and an anode 21 is fixed to the external periphery of the large-diameter portion by a plurality of screws. The conducting wire 63 and the anode 21 are electrically connected via the fixed shaft 10.

The previously described plating solution feeding channel 22 is formed along the radial direction of the main body of the fixed drum 20, and only the open end 22*a* thereof is exposed to the outside from the hole or gap of the anode 21 provided to the external periphery of the main body of the fixed drum 20. An annular groove 23*a* in the internal peripheral surface for receiving the plating solution flowing in from the transverse holes 11*b* in the fixed shaft 10 is provided to the main body of the fixed drum 20.

The rotating drum 30 is rotatably supported via bearings 41 and 42 on the external periphery of the fixed shaft 10. The top-side cylinder 31A as a component of the external peripheral cylinder 31 is detachably fixed by a screw to the external peripheral end of the top end-face panel 32, and the bottom-side cylinder 31B as a component of the external peripheral cylinder 31 is detachably fixed by a screw to the external peripheral end of the bottom end-face panel 33. The structure of the annular groove 34, the annular opening 35, and other components is the same as shown in FIG. 1.

Since other aspects of the structure are the same as described in the basic structure shown in FIG. 1, description thereof is omitted.

The plating method and operation thereof will next be described with reference to FIGS. 1 and 2.

When a plating treatment is performed on the workpiece W, the workpiece W that has been prepared for transport is wound in the annular groove 34 of the external peripheral cylinder 31 of the rotating drum 30. In this state, the plating solution is fed by the plating solution feeding system 50, and the workpiece W is transported while the anode 21 is energized via the fixed shaft 10, and a voltage is applied between the anode 21 and the workpiece W. The tunnel-shaped space 52 is then formed in the portion in which the workpiece W is wound, the plating solution is fed to this portion, the plating solution flows parallel to the plated-surface of the workpiece W, and the workpiece W is plated.

In this case, the plating solution is fed from the center 52*a* in the length direction of the tunnel-shaped space 52 and discharged from both ends 52*b* and 52*c* of the tunnel-shaped space 52. The spent plating solution is then discharged to the bottom of the plating bath from the discharge vents 39 via the arcuate space 28 formed on the external peripheral side of the small-diameter portion of the fixed drum 20.

In this plating device, a new rotating drum 30 is placed on the external periphery of the fixed drum 20 having the anode 21 on the external peripheral surface thereof, the workpiece W is wound on the external periphery of the rotating drum 30, and the workpiece W and the anode 21 face each other via the plating solution through the annular opening 35 formed in the external peripheral cylinder 31 of the rotating drum 30. It is therefore easier to manage the anode 21.

In other words, in such cases as when the plating type is changed, there is no need for any changes to be made on the side of the fixed drum 20 to which the anode 21 is attached, and a change need only be performed on the side of the rotor 30. Complex management of the fixed drum 20 on the side of the anode 21 is therefore no longer needed, which results in a potential reduction in cost.

The plating solution is fed to the tunnel-shaped space 52 enclosed by the workpiece W, the peripheral wall of the annular opening 35, and the external periphery of the fixed drum 20. The plating solution can therefore be caused to flow parallel to the plated surface at a high enough speed for adequate stirring effects to be demonstrated. Since the plating solution is fed in the center 52*a* in the length direction of the tunnel-shaped space 52, and the plating solution is discharged from both ends 52*b* and 52*c* of the tunnel-shaped space 52, the distance from the feeding point 52*a* to the discharge points 52*b* and 52*c* can be shortened, and plating burns can be prevented from forming. As a result, high-speed plating becomes possible.

A change in the plating specifications, for example, can be accommodated by replacing the mask 36. Particularly when the plating width is changed, for example, adaptation can be made simply by replacing at least the top-side cylinder 31A or the bottom-side cylinder 31B and changing the width of the annular opening 35. There is therefore no need to move or change the fixed drum 20 on the side of the anode 21.

Since the annular groove 34 is formed in the external peripheral cylinder 31 of the rotating drum 30, and the workpiece W is secured on the bottom surface of the annular groove 34, it is possible to shorten the distance between the workpiece W and the anode 21 through the annular opening 35, and the plating efficiency can be increased. The workpiece W is wound into the annular groove 34, and the winding position of the workpiece W in the width direction of the peripheral surface of the rotating drum 30 can therefore be set as well.

A simple, stable structure can be obtained since a fixed shaft 10 pointing in the vertical direction is provided through the center of the fixed drum 20 and rotating drum 30, and the fixed drum 20 and the rotating drum 30 are attached to the external periphery of the fixed shaft 10.

The top-side cylinder 31A and the bottom-side cylinder 31B are detachably attached to the external peripheral ends of the top end-face panel 32 and the bottom end-face panel 33, respectively. The top-side cylinder 31A and the bottom-side cylinder 31B can therefore easily be replaced while rigidity is maintained. Since the fixed drum 20 is contained in the rotating drum 30, a compact structure can be obtained, and the anode 21 attached to the fixed drum 20 can be protected. The spent plating solution is caused to fall downward from the discharge vent 39 in the bottom surface of the rotating drum 30, and unnecessary scattering of the spent plating solution can therefore be prevented as well.

Since a small-diameter portion is provided to the fixed drum 20, and the arcuate space 28 formed on the external peripheral side of the small-diameter portion is used as the discharge channel for the spent plating solution, the discharge properties of the spent plating solution can be improved.

In the configuration described above, the critical current density of the plating can be increased. For example, whereas the plating is burned at 20 A/dm$^2$ in the conventional plating device, it becomes possible to perform plating at a current density of 60 A/dm$^2$ or higher by using the plating device according to the present invention, and the current density can be further increased to 100 A/dm$^2$.

When an Au plating was performed by the plating device of the present invention, the plating rate was 14 μm/min. This was a significant improvement compared to the rate of 1 to 2 μm/min obtainable by the conventional plating device.

A case was described in the abovementioned embodiment in which at least one of the top- and bottom-side cylinders 31A and 31B is replaced when the width of the annular opening 35 is changed, but at least one of the top side and bottom-side cylinders 31A and 31B may be provided so as to be able to move in a direction whereby the width of the annular opening 35 can be changed.

In this plating device, the plating solution is fed in the center in the length direction of the tunnel-shaped space, and is discharged from both ends of the tunnel-shaped space. Therefore, the rotational axis of the fixed drum may be parallel or perpendicular to the mounting surface. Specifically, the rotational axis of the fixed drum may be set at a prescribed angle with respect to the mounting surface as required by the process for setting up the plating device.

EXAMPLES

The effects of the present invention will be specifically described hereinafter using examples.

Example 1

First, a copper strip having a width of 50 mm and a thickness of 0.3 mm was prepared, and electrolytic degreasing and acid cleaning were performed by a known method, after which a Ni plating having a thickness of 1 μm was formed as a base plating by a known method using a nickel sulfamate plating bath containing nickel sulfamate (concentration: 405 g/L) and boric acid (concentration: 40 g/L) at a temperature of 50° C.

An Au plating having a thickness of 0.1 μm was formed on the resultant Ni-plated copper strip using the plating device according to the present invention.

At this time, a drum device having a fixed drum diameter of 400 mm, a rotating drum diameter of 410 mm, a width of 10 mm in the annular groove as the flow channel, and an annular groove height of 20 mm was prepared as the plating device according to the present invention. The drum device was set with a mask opening width of 10 mm and a mask thickness of 3 mm, and a strip-shaped Au plating having a width of 10 mm was formed on the Ni-plated copper strip. A platinum plate having a height of 20 mm was used for the anode.

HS-10 manufactured by Kojundo Chemical Lab Co. was used as the Au plating solution, and solutions were prepared with Au concentrations of 10 g/L, 20 g/L, and 30 g/L.

The flow rates of the Au plating solution were 360 m/min, 170 m/min, and 50 m/min.

The temperatures of the Au plating solution were 50° C. and 60° C.

The current densities during plating were 10 A/dm$^2$, 60 A/dm$^2$, and 100 A/dm$^2$.

The Au plating rate when Au plating was performed under the above conditions was measured, and the appearance of the products was observed. An X-ray film thickness meter was used to measure the film thickness of the Au plating, and the plating rate was converted to (μm/min).

The measurement results are shown in Table 1.

As is apparent from the results in Table 1, when the plating device of the present invention was used, Au platings having a good appearance and no burning were obtained in all of the conditions described above. Among these results, a plating rate of 20 μm/min was obtained when the Au concentration was 30 g/L, the flow rate of the Au plating solution was 360 m/min, the temperature of the Au plating solution was 60° C., and the current density during plating was 100 A/dm$^2$.

Comparative Example 1

Figure 3A:
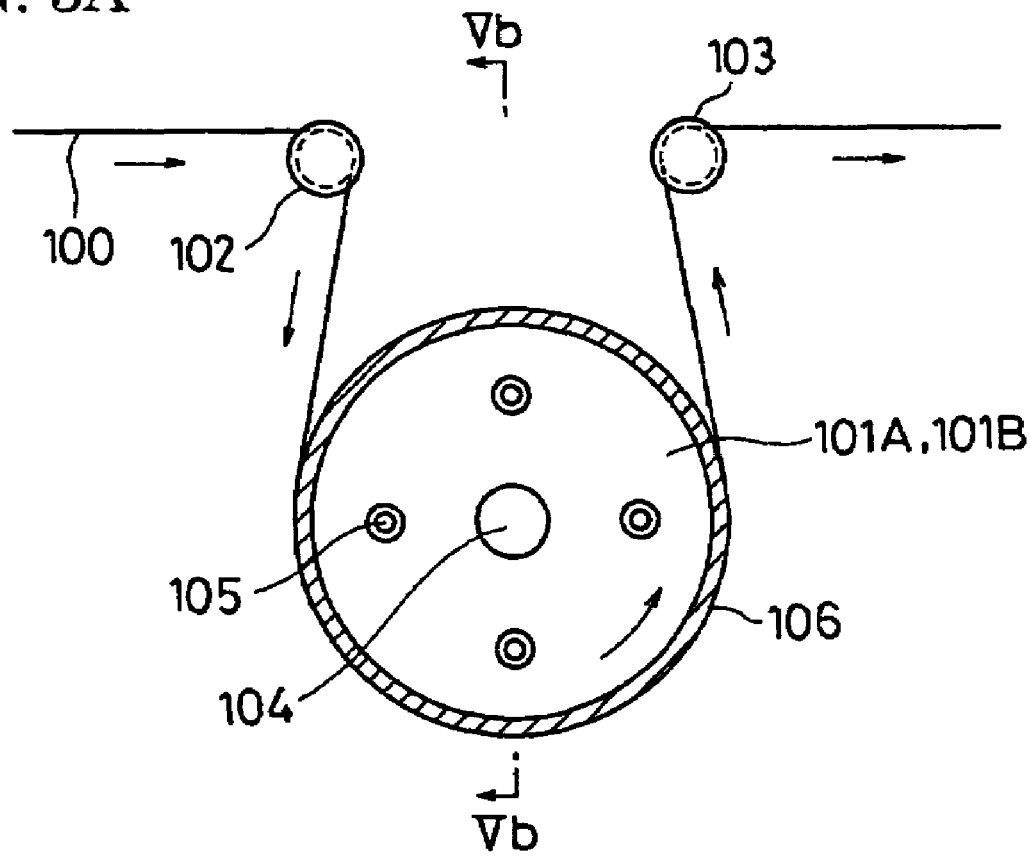
FIG. 3A is a side view.
Figure 3B:
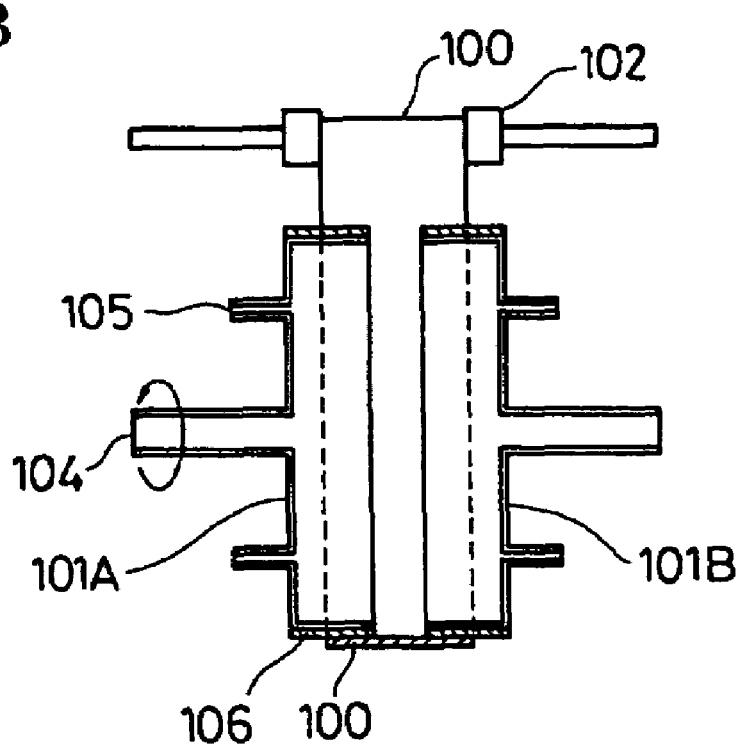
FIG. 3B is a sectional view along the arrow Vb-Vb in (a)
Figure 4A:
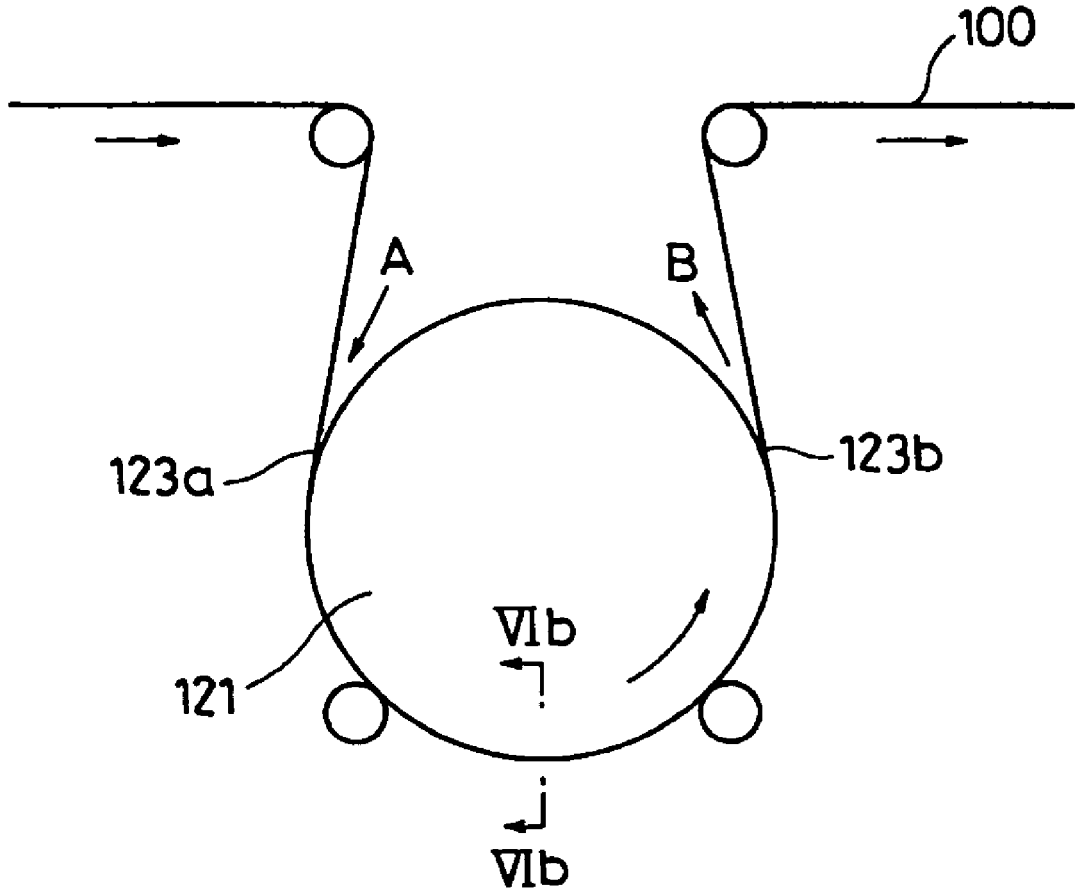
FIG. 4A is a side view, and 4B is a sectional view along the arrow VIb-VIb in FIG. 4A.
Figure 4B:
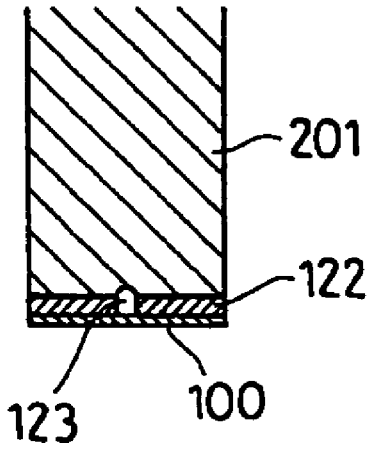

A plating device was prepared that was the same as the perpendicular-flow-type plating device according to the conventional technique shown in FIG. 3, had the same size drum as in Example 1, and had a drum in which the position of the plating solution discharge vent 105 was adjusted so that the plating solution was not retained inside the drum. The other conditions were the same as those in Working Example 1, and an Au plating having a thickness of 0.1 μm was formed on a Ni-plated copper strip.

The measurement results for this example are shown in Table 1.

As is apparent from Table 1, when the plating device of this comparative example was used, burning appeared when the plating rate was set to 3.8 μm/min, and the plating rate could not be increased.

TABLE 1

| | Flow | Au Concentration (g/L) | Flow Rate (m/min) | Temperature (° C.) | Current Density (A/dm$^2$) | Plating Rate (μm/min) | Appearance |
|---|---|---|---|---|---|---|---|
| Examples | Parallel | 10 | 360 | 50 | 10 | 1.7 | Good |
| | | 10 | 360 | 50 | 60 | 3.9 | Good |
| | | 10 | 360 | 50 | 100 | 6.4 | Good |
| | Parallel | 20 | 360 | 50 | 10 | 1.7 | Good |
| | | 20 | 360 | 50 | 60 | 5.7 | Good |
| | | 20 | 360 | 50 | 100 | 9.5 | Good |
| | Parallel | 30 | 360 | 50 | 10 | 1.8 | Good |
| | | 30 | 360 | 50 | 60 | 7.7 | Good |
| | | 30 | 360 | 50 | 100 | 13.5 | Good |
| | | 30 | 360 | 60 | 100 | 20.0 | Good |
| | | 30 | 170 | 50 | 100 | 9.9 | Good |
| | | 30 | 50 | 50 | 100 | 7.5 | Good |
| Comparative Examples | Perpendicular | 10 | 360 | 50 | 10 | 1.5 | Good |
| | | 30 | 360 | 50 | 10 | 1.7 | Good |
| | | 30 | 360 | 50 | 25 | 3.8 | Burned |

What is claimed is:

1. A plating device comprising:

a fixed drum in which a counter electrode is exposed on the external peripheral surface;

a rotor rotatably disposed via a prescribed gap on the external periphery of said fixed drum, and onto the external periphery of which a belt-shaped or linear workpiece transported in the longitudinal direction is wound with a prescribed arc of contact range;

an annular opening formed by the peripheral surface of said rotor onto which said workpiece is wound, and provided so as to continue in the peripheral direction of said rotor and penetrate from the external periphery to the internal periphery of the rotor;

a plating solution feeding channel formed inside said fixed drum having an open end corresponding to an angle position of said prescribed arc of contact of the rotor onto which said workpiece is wound; and a plating solution feeding system, enclosed by the workpiece wound onto the external periphery of said rotor, the peripheral wall of the annular opening formed in said rotor, and the external periphery of said fixed drum, for feeding the plating solution from said solution feeding channel to a duct using a tunnel-shaped space along the external periphery of the fixed drum as said duct, and discharging the plating solution from both ends of said tunnel-shaped space in which said workpiece and the rotor move away from each other.

2. The plating device according to claim 1, wherein said rotor is provided in a movable or replaceable manner so that the width of said annular opening can be changed.

3. The plating device according to claim 1, wherein an annular groove in which said workpiece is closely wound onto the bottom surface of the groove is formed in the external periphery of said rotor, and said annular opening having a size that is smaller than the width of the bottom surface of the groove is formed in the bottom surface of the annular groove.

4. The plating device according to claim 3, wherein a mask for defining the plating area is positioned on the bottom surface of said annular groove, and said workpiece can be wound onto the mask.

5. The plating device according to claim 1, wherein a fixed shaft pointing in the vertical direction is provided through the center of said fixed drum and rotor, said fixed drum is nonrotatably supported by the fixed shaft, and said rotor is rotatably supported in a substantially horizontal plane.

6. The plating device according to claim 5, wherein said rotor is detachably attached between the external peripheral ends of a top end-face panel and a bottom end-face panel rotatably supported by said fixed shaft; said fixed drum is accommodated by a space formed by the top and bottom end-face panels and the rotor; and a discharge vent for discharging the spent plating solution downward that is discharged from both ends of said tunnel-shaped space is provided to said bottom end-face panel.

7. The plating device according to claim 6, wherein said fixed drum is formed so that only the angle range thereof corresponding to said prescribed arc of contact range has a large diameter, and the remaining angle range has a small diameter, whereby an arcuate space is maintained on the external peripheral side of the portion formed by the small diameter, and the arcuate space is used as a discharge channel for discharging from said discharge vent the spent plating solution discharged from both ends of said tunnel-shaped space.

8. The plating device according to claim 2, wherein an annular groove in which said workpiece is closely wound onto the bottom surface of the groove is formed in the external periphery of said rotor, and said annular opening having a size that is smaller than the width of the bottom surface of the groove is formed in the bottom surface of the annular groove.

9. The plating device according to claim 2, wherein a fixed shaft pointing in the vertical direction is provided through the center of said fixed drum and rotor, said fixed drum is nonrotatably supported by the fixed shaft, and said rotor is rotatably supported in a substantially horizontal plane.

10. The plating device according to claim 3, wherein a fixed shaft pointing in the vertical direction is provided through the center of said fixed drum and rotor, said fixed drum is nonrotatably supported by the fixed shaft, and said rotor is rotatably supported in a substantially horizontal plane.

11. The plating device according to claim 4, wherein a fixed shaft pointing in the vertical direction is provided through the center of said fixed drum and rotor, said fixed drum is nonrotatably supported by the fixed shaft, and said rotor is rotatably supported in a substantially horizontal plane.

* * * * *